US006603945B2

(12) United States Patent
Amarakoon et al.

(10) Patent No.: US 6,603,945 B2
(45) Date of Patent: Aug. 5, 2003

(54) DUPLEX/SIMPLEX PRINTER

(75) Inventors: Kiri B. Amarakoon, Pittsford, NY (US); Clive R. Daunton, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/993,945

(22) Filed: Nov. 16, 2001

(65) Prior Publication Data

US 2003/0095816 A1 May 22, 2003

(51) Int. Cl.[7] ..... G03G 15/16
(52) U.S. Cl. ..... 399/309
(58) Field of Search ..... 399/297, 302, 399/307, 308, 309, 66

(56) References Cited

U.S. PATENT DOCUMENTS

| | | | | |
|---|---|---|---|---|
| 3,697,170 A | 10/1972 | Bhagat et al. | ..... | 430/124 |
| 4,427,285 A | 1/1984 | Stange | ..... | 399/306 |
| 4,714,939 A | 12/1987 | Ahern et al. | ..... | 399/309 |
| 5,132,712 A | 7/1992 | Fletcher et al. | ..... | 347/55 |
| 5,138,363 A | 8/1992 | Yuge | ..... | 399/309 |
| 5,204,716 A | 4/1993 | Kasahara et al. | ..... | 156/345.42 |
| 5,453,822 A | 9/1995 | Anzai et al. | ..... | 399/299 |

*Primary Examiner*—Hoan Tran
(74) *Attorney, Agent, or Firm*—Lloyd F. Bean, II

(57) ABSTRACT

A duplex/simplex printer for producing toner particle images on opposite sides of a substrate during a duplex mode or producing toner particle images on one side of the substrate during a simplex mode including: means for forming a first toner particle image on an imaging member with toner particles electrostatically charged to a first polarity; an image conditioner, being enable only during the duplex mode, for reversing the charge polarity of the particles of the first toner particle image on the imaging member; an intermediate member for receiving of the first toner particle image during the duplex mode; a bias transfer roll, positioned opposed from the imaging member with the intermediate member therebetween, for transferring the first image to the intermediate member by moving the intermediate member and the imaging member past the bias transfer roll being charged at the first polarity during the duplex mode, the duplex mode includes the forming means forming a second toner particle image on the imaging member with toner particles electrostatically charged to the first polarity and means for feeding a substrate between the intermediate member and the imaging member and a controller reversing the charge polarity of the bias transfer roll to a second polarity thereby simultaneously transfer charged particles of the first and second images to opposite sides of the substrate during the duplex mode.

10 Claims, 1 Drawing Sheet

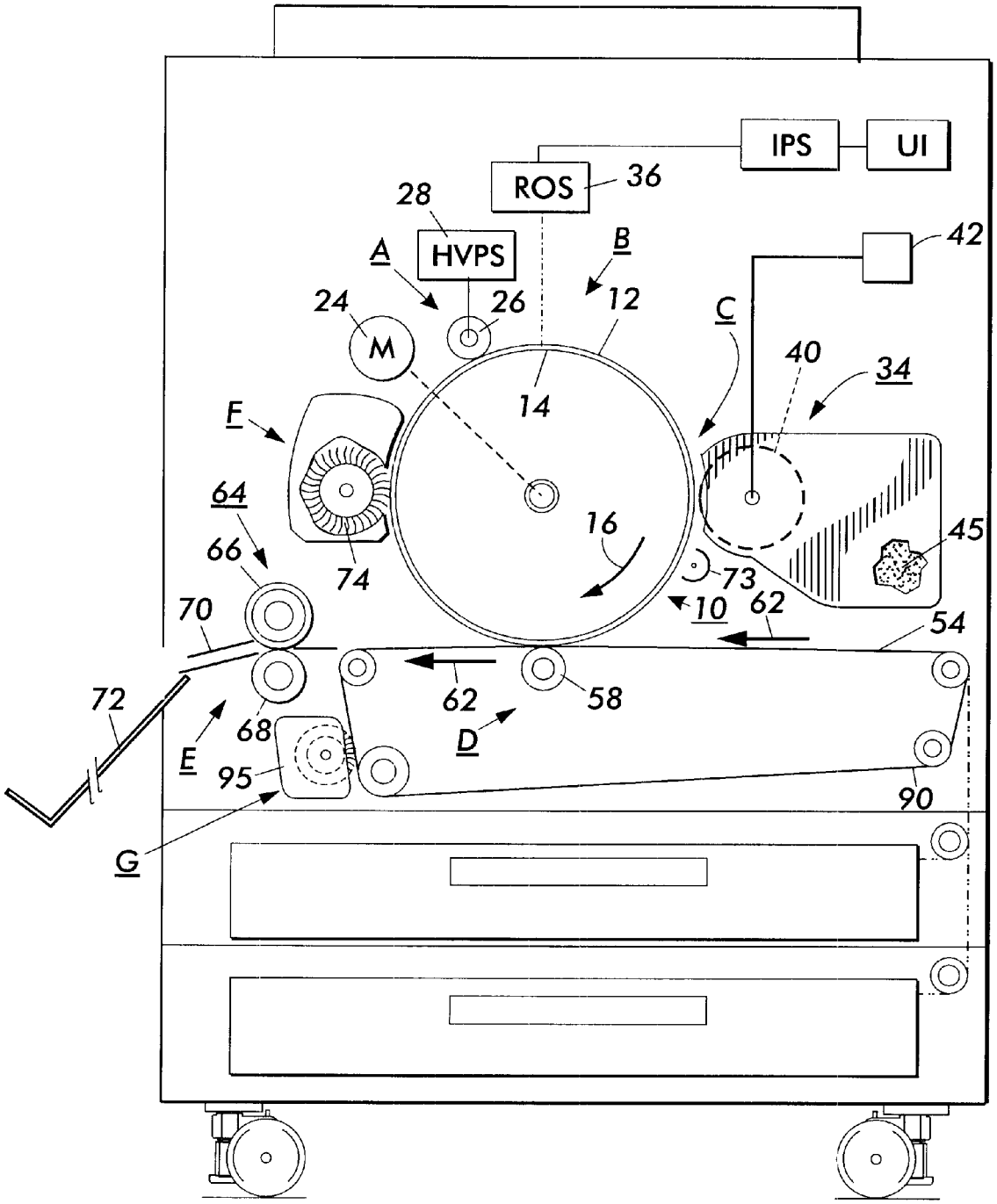
IPS
UI
ROS
36
28
HVPS
A
B
42
24
26
12
C
M
40
34
14
F
64
16
45
66
74
73
70
10
62
54
72
62
58
68
D
E
95
90
G

DUPLEX/SIMPLEX PRINTER

BACKGROUND OF THE INVENTION

This invention relates to electrostatic printing devices and more particularly to duplex printing.

Many methods for automatic duplex printing in xerographic processors are known. There is the two pass method employed in the Xerox 40000 and 9400® reproduction machines. That is, after the first side of copy sheets are imaged and fused, the sheets are collected in a duplex tray. After the last sheet in a set has been received in the duplex tray, the sheets are again passed through the xerographic processing stations. This time an image is transferred and fused onto the opposite side of each copy sheet having an image on the first side.

In the Xerox 9700® machine, the copy sheets also pass through the processing stations twice. However, they are not collected in a duplex tray. After the first image has been transferred and fused, the sheets pass through a stop and reverse mechanism (inverter). Then, the sheets join in an interleaving fashion the stream of copy sheets to receive an image on the opposite side.

There are some disadvantages with these systems, in particular for a given image throughput rate. For example, two passes through the fuser require more energy, and the fuser needs to operate at twice the speed. During the first pass through the fuser, the paper loses 50 percent of its moisture. This curls the paper and makes the second pass for duplexing difficult. Paper picks up oil on the first pass through the fuser, sometimes leading to image deletions on the second image and oil deposits on the photoreceptor. Jam rates during two-pass duplex operation are much greater than for simplex operation. In the first place, in a two-pass duplex system, the paper path is usually very long, and the paper has to negotiate all obstacles twice. Excessive paper curl is not only troublesome in the processor but also extremely difficult to handle in output stackers and finishing devices.

In other prior art systems such as in U.S. Pat. No. 4,095,979 means are shown for "immediate" or single-pass duplex copying or forming first and second images sequentially on a photoreceptor. The first image is transferred from the photoreceptor to the first side of a copy sheet. Then, the sheet is stripped off the photoreceptor, inverted while the first image remains unfixed, and then the second image is transferred to the second side of the copy sheet. Both images are then fixed onto the copy sheet by a suitable fuser. This type of system can be described as a "single-pass" to the fuser.

Other single-pass duplex printing methods use intermediate image carriers (belt or drum). The first and second images are sequentially formed on a photoreceptor. The first image is transferred to an intermediate image carrier. The copy sheet is then passed between the photoreceptor and the intermediate image carrier, simultaneously receiving first and second images.

The duplex methods discussed above only utilize one photoreceptor. Other systems, e.g. U.S. Pat. Nos. 3,580,070 and 3,775,102 deal with "single-pass duplex" methods employing two photoreceptors and two exposure systems. First, images are deposited on one photoreceptor and second images are deposited on the other photoreceptor. These systems are considered the ultimate duplex throughput systems since they produce twice the number of images of "two-pass duplex" systems at same process speed. These "single-pass duplex" systems, however, generally require web paper feed in which the copy is spooled up on a roll or cut into individual sheets after fusing. This unfortunately, introduces additional components and complexity into the system.

U.S. Pat. No. 4,427,285 discloses a discrete copy sheet feed system rather than a web paper feed system. A two photoreceptor, "single-pass duplex" apparatus is disclosed wherein two images are formed, one on each photoreceptor and then transferred to opposite sides of the image receiving sheet.

U.S. Pat. No. 4,714,939 discloses an electrographic reproduction apparatus, of the single-pass type, capable of producing simplex or duplex copies on a receiver sheet traveling in a continuous direction along a path. The reproduction apparatus comprises a first dielectric member movable along a first path, a portion of such first path being tangent to and on one side of the sheet travel path. Transferable images, corresponding to information to be reproduced, are sequentially formed on such first member. A second member is movable along a second path. One portion of such second path is tangent to the sheet travel path on the opposite side from the first path and another portion of the second path, spaced from such one portion, is located to position the second member in image transfer relation to the first dielectric member. An electrostatic field, reversible in its effective direction, is utilized to transfer a transferable image from the first dielectric member to the second member at the portion of the second path where the first and second members are in image transfer relation and transfer such image from the second member to one side of a receiver sheet traveling along its travel path at the location where the position of the first path is tangent to the sheet travel path and for producing a duplex copy, a second image is transferred from the first dielectric member to the opposite side of such receiver sheet at the location where the portion of the first path is tangent to the sheet travel path.

Another technique involving the use of only one photoconductor, utilizes an intermediate image transfer member to receive the first image formed on the photoconductor before transfer to a final support medium. The intermediate transfer member as disclosed in U.S. Pat. Nos. 3,671,118 and 3,697,170 is such a belt.

Some of the problems associated with the above techniques are in handling the unfixed image from first photoreceptor to the second photoreceptor can lead to image damage and complicate systems for handling an unfixed image through transport devices. Furthermore, to meet side one to side two registration requirements a re-registration device is needed.

SUMMARY OF THE INVENTION

There is provided a duplex/simplex printer for producing toner particle images on opposite sides of a substrate during a duplex mode or producing toner particle image on one side of the substrate during a simplex mode comprising: means for forming a first toner particle image on an imaging member with toner particles electrostatically charged to a first polarity; an image conditioner, being enable only during said duplex mode, for reversing the charge polarity of the particles of said first toner particle image on an imaging member; an intermediate member for receiving of said first toner particle image during said duplex mode; a bias transfer roll, positioned opposed from said imaging member with the intermediate member therebetween, for transferring said first image to said intermediate member by moving the intermediate member and the imaging members past said bias transfer roll being charged at said first polarity during said duplex mode, said duplex mode includes said forming means forming a second toner particle image on said imaging member with toner particles electrostatically charged to the first polarity and means for feeding a substrate between said intermediate member and said imaging and a controller reversing the charge polarity of said bias transfer roll to a second polarity thereby simultaneously transfer charged particles of said first and second images to opposite sides of said substrate during said duplex mode.

Other aspects of the present invention will become apparent as the following description proceeds and upon reference to the drawings, in which:

FIG. 1 is a schematic elevational view showing an illustrative electrophotographic printing machine incorporating the features of the present invention therein.

While the present invention will hereinafter be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims. For a general understanding of the features of the present invention, reference is made to the drawings. In the drawings, like reference numerals have been used throughout to designate identical elements.

Turning now to FIG. 1, the electrophotographic printing machine shown employs a photoconductive drum, although photoreceptors in the form of a belt are also known, and may be substituted therefor. The drum has a photoconductive surface deposited on a conductive substrate 14. The drum moves in the direction of arrow 16 to advance successive portions thereof sequentially through the various processing stations disposed about the path of movement thereof. Motor 24 rotates roll to advance drum in the direction of arrow 16. Drum is coupled to motor 24 by suitable means such as a drive.

Initially successive portions of drum pass through charging station A. At charging station A, a corona generating device, in the form of a bias charge roll (or a scorotron) which is indicated generally by the reference numeral 26, charges the drum 10 to a selectively high uniform electrical potential, preferably negative. Any suitable control, well known in the art including, for example, HVPS 28, may be employed for controlling the corona generating device 26.

The IPS contains control electronics which prepare and manage the image data flow to a raster output scanning device (ROS) (or an LED bar imager), indicated by numeral 36. A user interface (UI) is in communication with IPS. UI enables an operator to control the various operator adjustable functions, such as selecting portion document to be printed with a custom color. The operator actuates the appropriate keys of UI to adjust the parameters of the copy. UI may be a touch screen or any other suitable control panel providing an operator interface with the system. The output signal from UI is transmitted to the IPS. The IPS then transmits signals corresponding to the desired image to ROS 36, which creates the output copy image. The ROS illuminates, via mirror, the charged portion of a photoconductive drum. The ROS will expose the photoconductive drum to record single to multiple images which correspond to the signals transmitted from IPS.

At development station C, a development system or unit, indicated generally by the reference numeral 34 advances developer materials into contact with the electrostatic latent images. Preferably, the developer unit includes a developer roller mounted in a housing. Thus, developer unit 34 contains a developer roller 40. The roller 40 advances toner particles 45 into contact with the latent image. Appropriate developer biasing may be accomplished via power supply 42, electrically connected to developer unit 34.

The developer unit 34 develops the charged image areas of the photoconductive surface. This developer unit contains magnetic black toner particles 45, for example, which are charged by the electrostatic field existing between the photoconductive surface and the electrically biased developer roll in the developer unit. Power supply 42 electrically biases the magnetic roll 40.

In simplex operation, a sheet of support material 54 is moved into contact with the toner image at transfer station D. The sheet of support material is advanced to transfer station D into contact with the photoconductive surface of drum 10 in a timed sequence so that the toner powder image developed thereon contacts the advancing sheet of support material at transfer station D.

Transfer station D includes a corona generating device 58 in the form of a bias charge roll, which applies ions of a suitable polarity (say positive) onto the backside of an intermediate belt 90 to induce a charge on sheet 54. This attracts the toner powder image from the drum 10 to sheet 54. After transfer, the sheet continues to move on intermediate belt 90, in the direction of arrow 62 to fusing station E.

Fusing station E includes a fuser assembly, indicated generally by the reference numeral 64, which permanently affixes the transferred powder image to sheet 54. Preferably, fuser assembly 64 comprises two heated fuser rollers 66 and 68. Sheet 54 passes between fuser roller 66 and roller 68 with the toner powder image contacting fuser roller 66. In this manner, the toner powder image is permanently affixed to sheet 54. After fusing, a chute 70 guides the advancing sheet 54 to a catch tray 72 for subsequent removal from the printing machine by the operator.

After the sheet of support material is separated from the photoconductive surface of drum 10, the residual toner particles carried by image and the non-image areas on the photoconductive surface removed at cleaning station F. The vacuum assisted, electrostatic, brush cleaner unit or cleaning blade is disposed at the cleaning station F to remove any residual toner remaining on the surface of the drum.

During duplex operation, a first toner image is developed as previous described, however before transferring the image to the intermediate belt 90, the polarity of the image is changed from negative to positive using a corona device 73. The image is transferred onto an imageable seam intermediate transfer belt 90. Preferably the belt includes a semiconductive substrate layer that has its ends joined together to form a continuous belt using mechanically interlocking "puzzle-cut" tabs that form a seam. The substrate layer can be made from a number of different materials, including polyesters, polyurethanes, polyimides, polyvinyl chlorides, polyolefins (such as polyethylene and polypropylene) and/or polyamides (such as nylon), polycarbonates, or acrylics, or blends or alloys of such materials. If required, the selected material is modified by the addition of an appropriate filler such that the substrate layer has a desired electrical conductivity. Appropriate fillers can include for example carbon, Accufluor®) fluorinated carbon black, and/or polyanaline, polythiophene or other conductive fillers or polymers. Donor salts can also be used. The substrate layer material should have the physical characteristics appropriate to an intermediate transfer application, including good tensile strength (Young's modulus, typically $1\times10^3$ to $1\times10^6$ Newton's/m$^2$), resistivity (typically less than $10^{13}$ ohm cm volume resistivity, greater than $10^8$ ohms/square lateral resistivity), thermal conductivity, thermal stability, flex strength, and high temperature longevity. See, U.S. patent application Ser. No. 09/460,896, entitled "Imageable Seam Intermediate Transfer Belt Having An Overcoat," by Edward L. Schlueter, Jr. et al., and Ser. No. 09/460,821 entitled "Imageable Seam Intermediate Transfer Belt," by Gerald M. Fletcher et al., both filed on Dec. 14, 1999.

Prior to the toner area arriving at that transfer nip the toner area is uniformly charged by a corona device 73 to change the toner charge on the image to the opposite polarity. This enables transfer of the first toner from the intermediate belt to the media and negatively charged second toner image from the photoreceptor simultaneously. This also reduces the impact of any stray, low or oppositely charged toner that might result in back transfer of toner to the photoconductive surface or intermediate belt. At the transfer nip, corona generating device 58 in the form of a bias charge roll, which applies ions of a suitable polarity onto the backside intermediate belt 100 to induce a charge on the top surface of the intermediate belt. This attracts the toner powder image from the drum 10 to intermediate belt.

Next the second image is recorded and developed onto drum 10; a sheet of support material 54 is moved into contact with the toner images at transfer station D. The sheet of support material is advanced to transfer station D into contact with the second toner image on photoconductive surface of drum 10 and the first toner image on intermediate belt 100 in a timed sequence so that the both toner powder images developed contacts the advancing sheet of support material at transfer station D.

Corona generating device 58 applies ions of a suitable polarity onto the backside intermediate belt 100 to induce a charge on sheet 54. This attracts the second toner powder image from the drum 10 to sheet 54 and to repel the first toner powder image from intermediate belt 100 to sheet 54. After transfer, the sheet continues to move on intermediate belt 100, in the direction of arrow 62 to fusing station E. Sheet 54 passes between fuser roller 66 and roller 68 with the toner powder image contacting fuser roller 66 and 68. In this manner, the toner powder image is permanently affixed to sheet 54. After fusing, a chute 70 guides the advancing sheet 54 to a catch tray 72 for subsequent removal from the printing machine by the operator.

After the sheet of support material is separated from the surface of intermediate belt 100, the residual toner particles carried by image and the non-image areas on the photoconductive surface and intermediate surface removed at cleaning station F and G. The vacuum assisted, electrostatic, brush cleaner unit or cleaning blade is disposed at the cleaning station F and G to remove any residual toner remaining on the surface of the drum and the intermediate belt.

Controller (not shown) controls the charging levels transfer bias roll 58 and also controls the caming of cleaner G. During simplex operation, charging device 73 is disable and transfer bias roll is bias to a polarity opposite to the polarity of the image when the toner image is transferred to the sheet.

During duplex operation, cleaner G is cammed away from intermediate belt; image conditioner 73 is enable and charges the first toner image (eg. Negative) to an opposite polarity (eg. positive). Next, transfer bias roll is bias to a polarity (eg. Negative) opposite to the polarity of the image so that the toner image is transferred to intermediate belt 100. When, the second toner image (eg. Negative) is produced image conditioner 73 is disabled and transfer bias roll is bias to a polarity opposite (eg. Positive) to the polarity of the second toner image and bias roll has same polarity of the first image (eg. Positive). Bias roll is bias to transferred the first and second images to the sheet. Next, cleaner G is cammed in contact with intermediate belt.

An advantageous feature of the present invention is that the polarity of the first image is changed on the photoreceptor thus reducing the complexity of architecture. The images are sequenced digitally thus enabling image manipulation to achieve excellent image quality and side one to side registration. Transfer is achieved via a Biased Transfer Roll enabling improved image quality.

While this invention has been described in conjunction with various embodiments, it is evident that many alternatives, modifications, and variations will be apparent to those skilled in the art. Accordingly, it is intended to embrace all such alternatives, modifications, and variations as fall within the spirit and broad scope of the appended claims.

What is claimed:

1. A duplex/simplex printer for producing toner particle images on opposite sides of a substrate during a duplex mode or producing toner particle image on one side of the substrate during a simplex mode comprising:

means for forming a first image on an imaging member with marking particles electrostatically charged to a first polarity;

an image conditioner, being enable only during said duplex mode, for reversing the charge polarity of the particles of said first image on the imaging member;

an intermediate member for receiving of said first image during said duplex mode;

a bias transfer roll, positioned opposed from said imaging member with the intermediate member therebetween, for transferring said first image to said intermediate member by moving the intermediate member and the imaging member past said bias transfer roll being charged at said first polarity during said duplex mode, said duplex mode includes said forming means forming a second image on said imaging member with marking particles electrostatically charged to the first polarity and means for feeding the substrate between said intermediate member and said imaging member and a controller for reversing the charge polarity of said bias transfer roll to a second polarity thereby simultaneously transfer charged particles of said first and second images to opposite sides of said substrate during said duplex mode.

2. The duplex/simplex printer of claim 1, further including a dual roll fuser for fusing said first and second images to the opposite sides of said substrate.

3. The duplex/simplex printer of claim 1, wherein said simplex mode includes said controller disabling said image conditioner and biasing said transfer roll to said second polarity when said first image on said imaging member pass said bias transfer roll with said substrate therebetween.

4. The duplex/simplex printer of claim 1, wherein said imaging member includes a photoconductive member.

5. The duplex/simplex printer of claim 1, wherein said forming means includes an LED bar imager.

6. An electrostatic printing machine for producing toner particle images on opposite sides of a substrate during a duplex mode or producing toner particle image on one side of the substrate during a simplex mode comprising:

means for forming a first toner particle image on an imaging member with toner particles electrostatically charged to a first polarity;

an image conditioner, being enable only during said duplex mode, for reversing the charge polarity of the particles of said first toner particle image on the imaging member;

an intermediate member for receiving of said first toner particle image during said duplex mode;

a bias transfer roll, positioned opposed from said imaging member with the intermediate member therebetween, for transferring said first toner particle image to said intermediate member by moving the intermediate member and the imaging member past said bias transfer roll being charged at said first polarity during said duplex mode, said duplex mode includes said forming means forming a second toner particle image on said imaging member with toner particles electrostatically charged to the first polarity and means for feeding the substrate between said intermediate member and said imaging member and a controller for reversing the charge polarity of said bias transfer roll to a second polarity thereby simultaneously transfer charged particles of said first and second toner particle images to opposite sides of said substrate during said duplex mode.

7. The printer of claim 6, further including a dual roll fuser for fusing said first and second toner particle images to the opposite sides of said substrate.

8. The printer of claim 6, wherein said simplex mode includes said controller disabling said image conditioner and biasing said transfer roll to said second polarity when said first toner particle image on said imaging member pass said bias transfer roll with said substrate therebetween.

9. The printer of claim 6, wherein said imaging member includes a photoconductive member.

10. The printer of claim 6, wherein said forming means includes an LED bar imager.

* * * * *